US008833214B2

(12) United States Patent
Wang

(10) Patent No.: US 8,833,214 B2
(45) Date of Patent: Sep. 16, 2014

(54) TOOL HANDLE

(76) Inventor: Tzu-Chien Wang, Tainan (TW)

( * ) Notice: Subject to any disclaimer, the term of this patent is extended or adjusted under 35 U.S.C. 154(b) by 423 days.

(21) Appl. No.: 13/436,921

(22) Filed: Mar. 31, 2012

(65) Prior Publication Data

US 2013/0055861 A1 Mar. 7, 2013

(30) Foreign Application Priority Data

Sep. 7, 2011 (TW) ..... 100216704 U

(51) Int. Cl.
*B25G 1/08* (2006.01)

(52) U.S. Cl.
CPC ..... *B25G 1/085* (2013.01)
USPC ..... 81/490; 81/177.4

(58) Field of Classification Search
USPC ..... 81/490, 177.4, 436–461
See application file for complete search history.

(56) References Cited

U.S. PATENT DOCUMENTS

| | | | | |
|---|---|---|---|---|
| 5,265,504 | A * | 11/1993 | Fruhm | 81/439 |
| 6,305,815 | B1 * | 10/2001 | Lin | 362/119 |
| 6,510,768 | B2 * | 1/2003 | Fruhm | 81/490 |
| 7,258,046 | B2 * | 8/2007 | Fruhm et al. | 81/177.4 |
| 7,395,739 | B1 * | 7/2008 | Chen | 81/177.4 |
| 7,779,732 | B2 * | 8/2010 | Abel et al. | 81/177.4 |
| 8,590,432 | B2 * | 11/2013 | Wang | 81/177.4 |

* cited by examiner

*Primary Examiner* — Bryan R Muller

(57) ABSTRACT

A tool handle includes a handle receiving a bit seat movable between a storage received in a compartment of the handle and an extended position partially outside of the handle. The bit seat includes a pivotable seat, a reciprocating member, a coupling seat, and an end cap. The reciprocating member includes a resilient arm abutting against an abutment wall of the pivotable base to constrain movement. The end cap includes a tongue extending through and engaged in a central hole of the coupling seat and a receiving hole of the reciprocating member. The end cap covers an opening of the compartment when the bit seat is in the storage position. The coupling seat receives screwdriver bits. The coupling seat is located outside of the compartment when the bit seat is in the extended position.

6 Claims, 7 Drawing Sheets

TOOL HANDLE

BACKGROUND OF THE INVENTION

The present invention relates to a tool handle and, more particularly, to a tool handle that can receive screwdriver bits and that can be stably moved between a storage position and an extended position.

Conventional screwdrivers include a handle and a shank having an end fixed to the handle, with a bit formed on the other end of the shank. However, the bits of the screwdrivers are fixed in size such that the user has to carry many screwdrivers with different sizes, leading to inconvenience to use and carriage.

To meet this end, handles receiving bits of different sizes are proposed to provide utility. A screwdriver of this type generally includes a shank fixed to a handle having a compartment receiving a bit seat that receives a plurality of bits and that can be moved between a storage position and an extended position. A user can select the desired bit from the bit seat in the extended position and couple it with the shank. The user can hold the handle and use the screwdriver when the bit seat is in the storage position. However, the movement of the bit seat between the storage position and extended position is not stable, leading to inconvenience to operation.

U.S. Pat. No. 7,258,046 discloses a retainer mounted in a sleeve for constraining slideable movement of the sleeve along a shaft between open and closed positions. The retainer is coupled to a spring that provides the movement constraining function. Although the movement of the operation is more stable, an additional spring is required. Furthermore, the retainer is separate from the spring such that the spring is liable to sway or fall off, leading to unstable operation.

BRIEF SUMMARY OF THE INVENTION

An objective of the present invention is to provide a tool handle that can receive screwdriver bits and that can be stably moved between a storage position and an extended position.

A tool handle according to the present invention includes a handle 1 having a compartment, with the compartment having an opening in a rear end thereof in a longitudinal direction of the handle. The compartment includes an inner periphery having an abutment rib. A bit seat is received in the compartment of the handle. The bit seat is movable relative to the handle between a storage position received in the compartment and an extended position partially outside of the compartment. The bit seat includes a pivotable base, a reciprocating member, a coupling seat, and an end cap.

The pivotable base includes a longitudinal hole and an outer periphery having an abutment flange. The abutment rib of the handle abuts the abutment flange of the pivotable base, preventing the pivotable base from moving in the longitudinal direction of the handle. The longitudinal hole of the pivotable base includes an inner periphery having a first abutment wall with two ends. The ends of the first abutment wall respectively include front and rear positioning holes.

The reciprocating member includes a column 41 on a front end thereof. The column extends through the longitudinal hole of the pivotable base. The reciprocating member is movable in the longitudinal direction relative to the pivotal base and not rotatable relative to the pivotal base. The reciprocating member includes a first resilient arm corresponding to first abutment wall. The first resilient arm includes a positioning member on a front end thereof. The reciprocating member further includes an engaging portion on a rear end thereof. The engaging portion has a receiving hole.

The coupling seat includes a plurality of bit grooves in an outer periphery thereof. The plurality of bit grooves is adapted for receiving a plurality of screwdriver bits. The coupling seat includes a central hole. The end cap includes a tongue on a front end thereof and a base on a rear end thereof. The tongue extends through and engaged in the central hole of the coupling seat and the receiving hole of the reciprocating member in the longitudinal direction. The reciprocating member, the coupling seat and the end cap are jointly movable in the longitudinal direction.

When the bit seat is in the storage position, the coupling seat is received in the compartment of the handle, the end cap covers the opening of the handle, the positioning member of the first resilient arm of the reciprocating member is engaged with the front positioning hole of the first abutment wall.

When the bit seat is moved to the extended position by pulling the end cap away from the handle, the coupling seat moves out of the compartment of the handle, the first resilient arm abuts against the first abutment wall to constrain movement, and the positioning member of the first resilient arm of the reciprocating member is engaged with the rear positioning hole of the first abutment wall. The end cap is pivotable to pivot the pivotable base, the reciprocating member, and the coupling seat relative to the handle.

Preferably, a stop is formed on the inner periphery of the compartment of the handle. The reciprocating member includes an annular portion on the rear end thereof. The annular portion includes a positioning hole. The annular portion is located in the opening of the handle when the bit seat is in the extended position. The stop of the handle is engaged with the positioning hole of the annular portion when the bit seat is in the storage position, preventing the bit seat from rotating relative to the handle.

Preferably, the pivotable base includes a resilient annular wall on the outer periphery thereof. The resilient annular wall includes a plurality of slits to provide the resilient annular wall with a room for flexible movement. The abutment flange is formed on an end of the resilient annular wall.

Preferably, the inner periphery of the longitudinal hole of the pivotable base includes two guiding grooves. The column of the reciprocating member includes two guiding wings slideably received in the two guiding grooves.

Preferably, the inner periphery of the longitudinal hole of the pivotal seat includes a second abutment wall opposite to the first abutment wall. The reciprocating member includes a second resilient arm corresponding to second abutment wall. The second resilient arm abuts against the second abutment wall. Each of the first and second resilient arms includes a slit to provide the first and second resilient arms with rooms for flexible movement. The second resilient arm includes a positioning member on a front end thereof. The positioning member of each of the first and second resilient arms includes a slant guiding face and an abutment edge. Two rear stops are respectively formed behind the rear positioning holes of the first and second abutment walls. A spacing between outer edges of the positioning members of the first and second resilient arms is smaller than a spacing between the first and second abutment walls of the pivotable base. Each of the first and second abutment walls has front and rear inclined guiding faces at the two ends thereof. The front inclined guiding faces guide the positioning members of the first and second resilient arms into a space between the first and second abutment walls when the bit seat is moved from the storage position to the extended position. The positioning members of the reciprocating member are moved into the rear positioning holes of the first and second abutment walls under action of the first and second resilient arms when the positioning members reach a location aligned with the rear inclined guiding faces. The abutment edges abut the two rear stops to prevent the reciprocating member from disengaging from the handle. When the bit seat is moved from the extended position to the storage position, the positioning members of the reciprocating member are moved into the front positioning holes of the first and second abutment walls under action of the first and second resilient arms when the positioning members reach a location aligned with the front inclined guiding faces.

Preferably, the receiving hole of the engaging portion of the reciprocating member includes an inner periphery having a coupling hole and a coupling member. An engaging slot is defined in the inner periphery of the receiving hole of the engaging portion. The central hole of the coupling seat includes an inner periphery having a coupling hole. A protrusion is formed on the front end of the inner periphery of the central hole of the coupling seat. The protrusion is engaged with the engaging slot of the reciprocating member, preventing the coupling seat from rotating relative to the reciprocating member. The tongue of the end cap includes a coupling member and a coupling hole. The coupling member of the tongue is engaged with the coupling hole of the reciprocating member. The coupling member of the reciprocating member is engaged in the coupling hole of the tongue of the end cap. The tongue further includes an engaging member engaged with the coupling hole of the coupling seat.

The present invention will become clearer in light of the following detailed description of illustrative embodiments of this invention described in connection with the drawings.

DETAILED DESCRIPTION OF THE INVENTION

Figure 1:
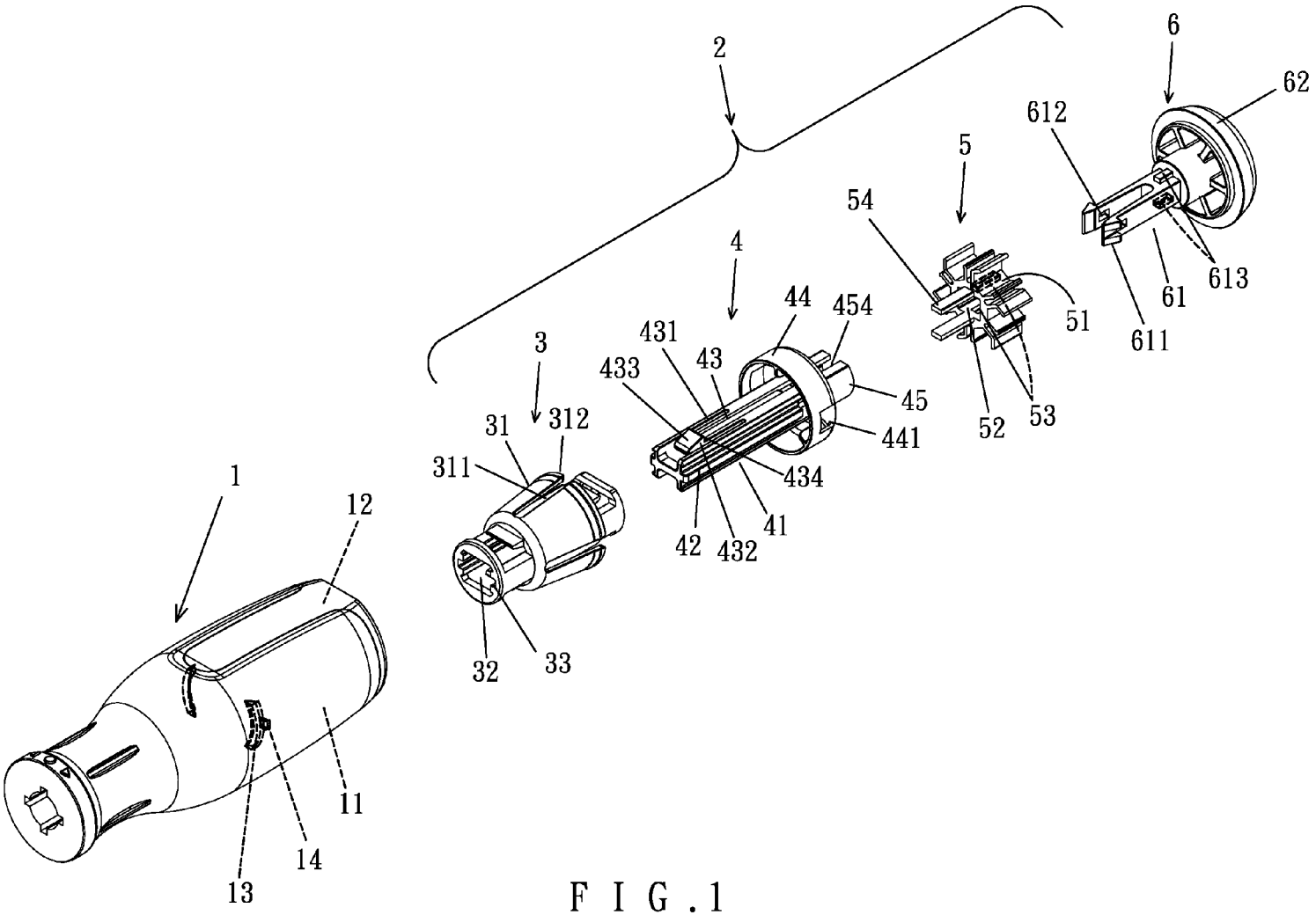
FIG. 1 shows an exploded, perspective view of a tool handle according to the present invention.
Figure 2:
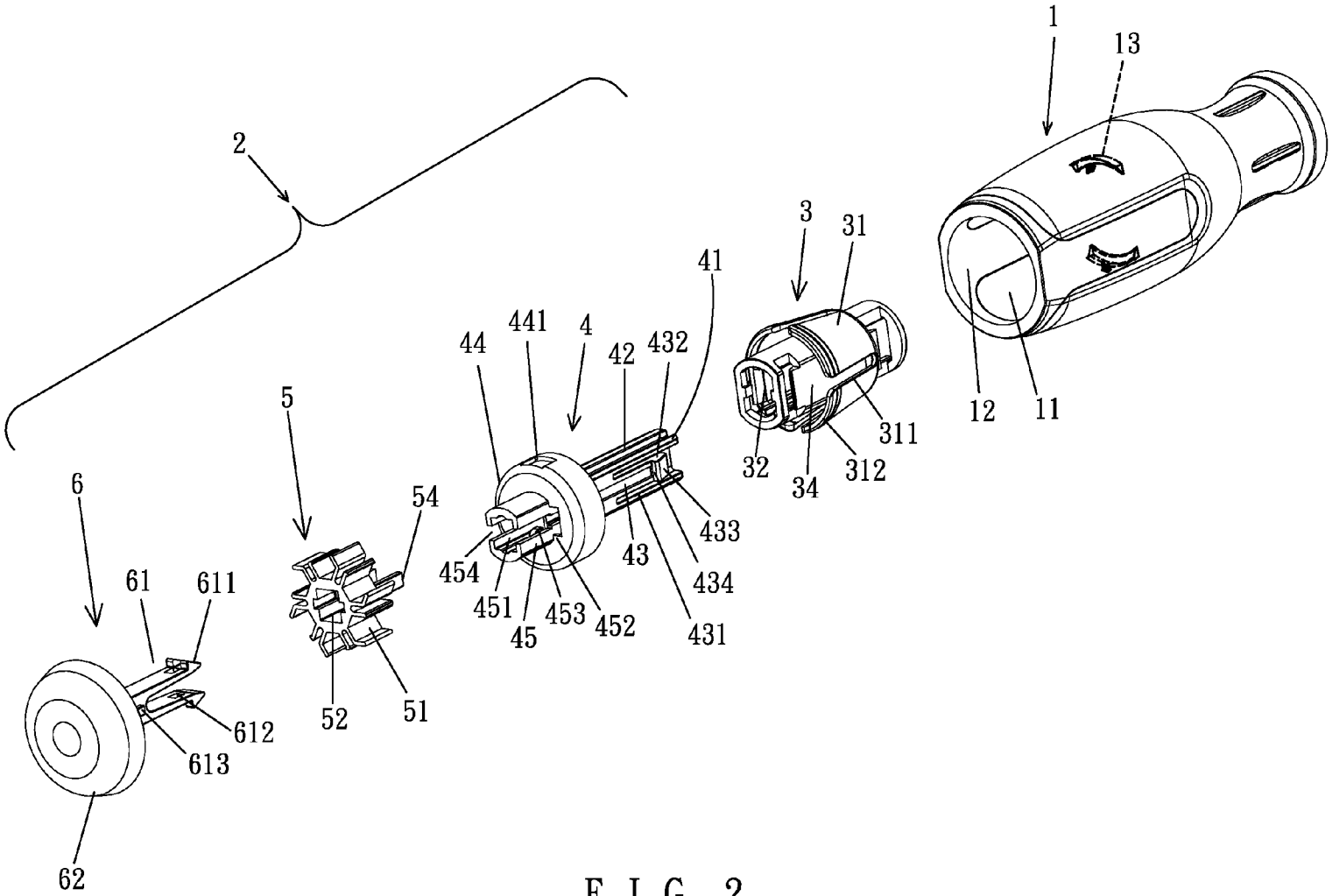
FIG. 2 shows another, exploded, perspective view of the tool handle of FIG. 1.

With reference to FIGS. 1-4, a tool handle according to the present invention includes a handle 1 and a bit seat 2. The handle 1 includes a compartment 11 having an opening 12 in a rear end thereof in a longitudinal direction of the handle 1. The compartment 11 includes an inner periphery having an abutment rib 13 and a stop 14.

The bit seat 2 is received in the compartment 11 of the handle 1 and movable relative to the handle 1 between a storage position received in the compartment 11 and an extended position partially outside of the compartment 11. The bit seat 2 including a pivotable base 3, a reciprocating member 4, a coupling seat 5, and an end cap 6.

The pivotable base 3 includes a resilient annular wall 31 on an outer periphery thereof. The resilient annular wall 31 includes a plurality of slits 311 to provide the resilient annular wall 31 with a room for flexible movement. An abutment flange 312 is formed on an end of the resilient annular wall 31. The pivotable base 3 includes a longitudinal hole 32 having an inner periphery in which two guiding grooves 33 are defined. The inner periphery of the longitudinal hole 32 further includes opposite first and second abutment walls 34. Each of the first and second abutment walls 34 includes front and rear inclined guiding faces 341 and 342 at two ends thereof, with front and rear positioning holes 344 respectively defined in locations adjacent to front and rear inclined guiding faces 341 and 342, and with a rear stop 345 formed behind the rear positioning hole 344.

The reciprocating member 4 includes a column 41 on a front end thereof. The column 41 extends through the longitudinal hole 32 of the pivotable base 3. The column 41 of the reciprocating member 4 includes two guiding wings 42 slideably received in the guiding grooves 33 of the pivotable base 3. The longitudinal hole 32 and the column 41 have non-circular cross sections such that the reciprocating member 4 is movable in the longitudinal direction relative to the pivotal base 3 but not rotatable relative to the pivotal base 3. The reciprocating member 4 includes first and second resilient arms 43 corresponding to the first and second abutment walls 34 of the pivotable base 3. Each of the first and second resilient arms 43 includes a slit 431 to provide the first and second resilient arms 43 with rooms for flexible movement. Each of the first and second resilient arms 43 further includes a positioning member 432 on a front end thereof, with the positioning member 432 including a slant guiding face 433 and an abutment edge 434. A spacing between outer edges of the positioning members 432 of the first and second resilient arms 43 is smaller than a spacing between the first and second abutment walls 34 of the pivotable base 3.

The reciprocating member 4 further includes an annular portion 44 and an engaging portion 45 on a rear end thereof. The annular portion 44 includes a positioning hole 441. The engaging portion 45 has a receiving hole 451. An inner periphery of the receiving hole 451 of the engaging portion 45 includes a coupling hole 452 and a coupling member 453. An engaging slot 454 is defined in the inner periphery of the receiving hole 451 of the engaging portion 45.

Figure 6:
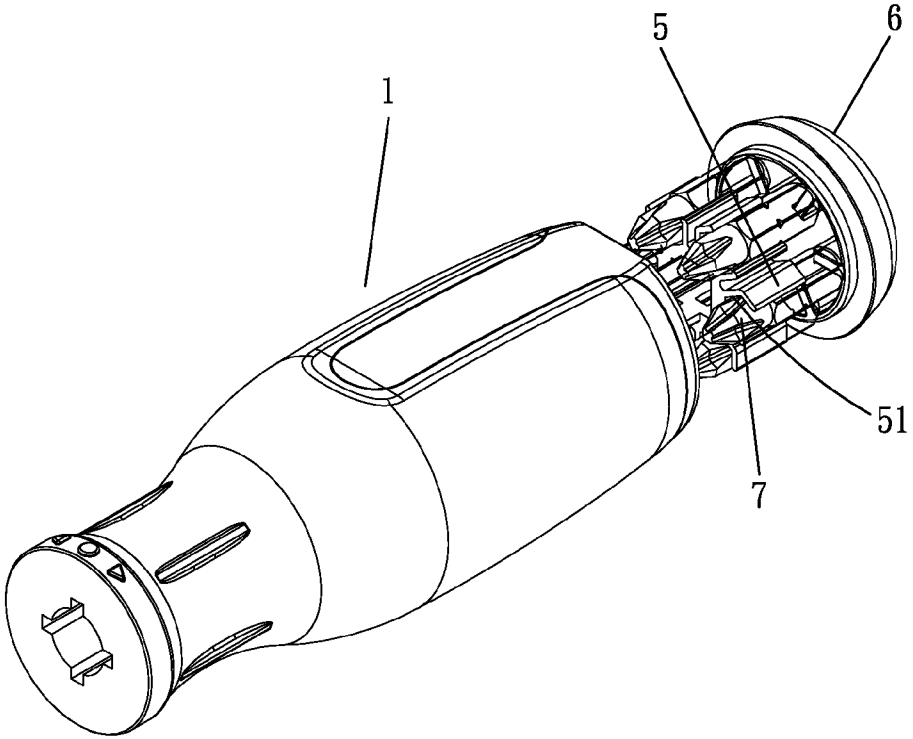
FIG. 6 shows a perspective view of the tool handle, with the bit seat in the extended position.

The coupling seat 5 includes a plurality of bit grooves 51 in an outer periphery thereof. The bit grooves 51 are adapted for receiving a plurality of screwdriver bits 7 (FIG. 6). The coupling seat 5 includes a central hole 52. An inner periphery of the central hole 52 of the coupling seat 5 includes a coupling hole 53. A protrusion 54 is formed on the front end of the inner periphery of the central hole 52 of the coupling seat 5. The protrusion 54 is engaged with the engaging slot 454 of the reciprocating member 4, preventing the coupling seat 5 from rotating relative to the reciprocating member 4.

The end cap 6 includes a tongue 61 on a front end thereof and a base 62 on a rear end thereof. The tongue 61 extends through and is engaged in the central hole 52 of the coupling seat 5 and the receiving hole 451 of the reciprocating member 4 in the longitudinal direction. The tongue 61 of the end cap 6 includes a coupling member 611 and a coupling hole 612. The coupling member 611 of the tongue 61 is engaged with the coupling hole 452 of the reciprocating member 4, and the coupling member 453 of the reciprocating member 4 is engaged in the coupling hole 612 of the tongue 61 of the end cap 6, providing increased engagement effect. The tongue 61 further includes an engaging member 613 engaged with the coupling hole 53 of the coupling seat 5. Thus, the reciprocating member 4, the coupling seat 5 and the end cap 6 are jointly movable in the longitudinal direction.

The bit seat 2 is movable relative to the handle 1 between the storage position and the extended position. The abutment rib 13 of the handle 1 abuts the abutment flange 312 of the pivotable base 3, preventing the pivotable base 3 from moving in the longitudinal direction of the handle 1.

Figure 3:
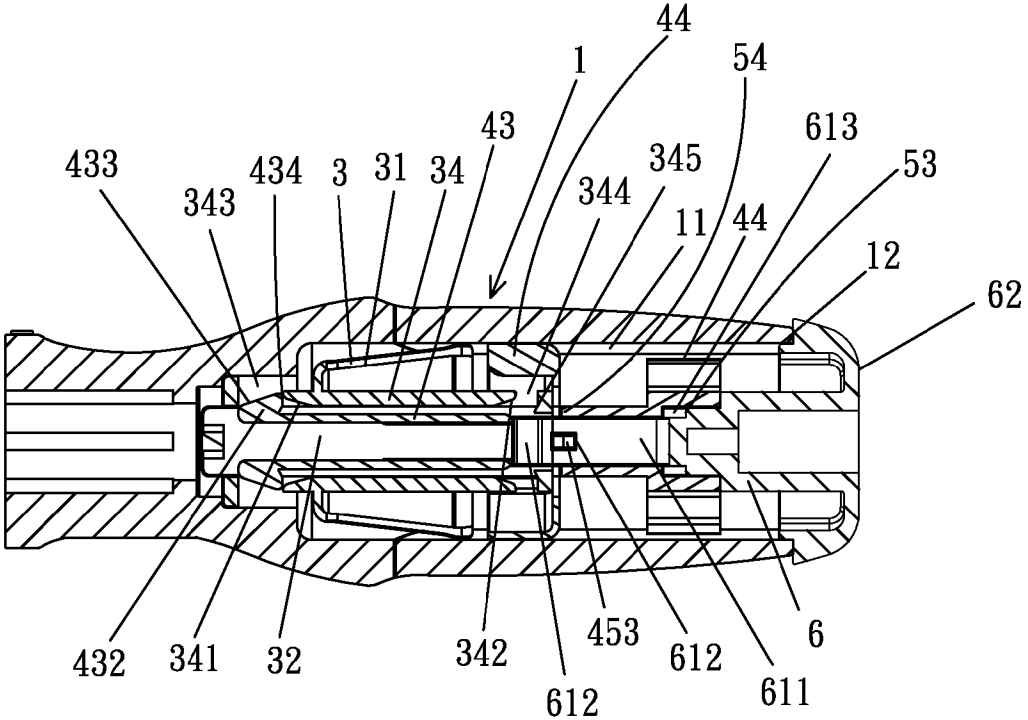
FIG. 3 shows a cross sectional view of the tool handle of FIG. 1, with a bit seat in a storage position.
Figure 4:
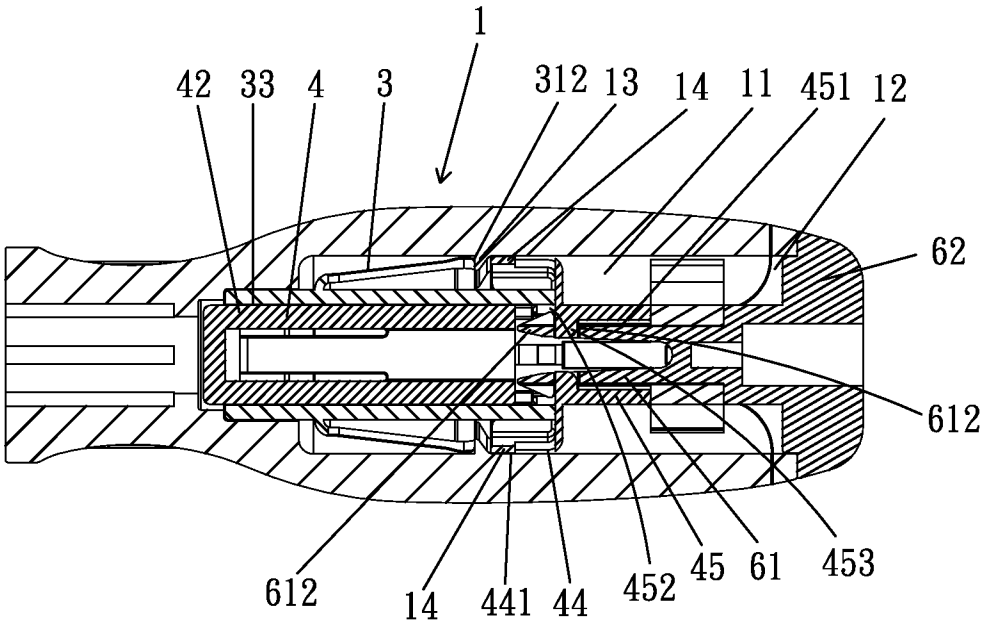
FIG. 4 shows another cross sectional view of the tool handle of FIG. 3.

With reference to FIGS. 3 and 4, when the bit seat 2 is in the storage position, the coupling seat 5 is received in the compartment 11 of the handle 1, the base 62 of the end cap 6 covers the opening 12 of the handle 1, the positioning members 432 of the first and second resilient arms 43 of the reciprocating member 4 are engaged with the front positioning holes 343 of the first and second abutment walls 34. The stop 14 of the handle 1 is engaged with the positioning hole 441 of the annular portion 44 when the bit seat 2, preventing the bit seat 2 from rotating relative to the handle 1.

Figure 5:
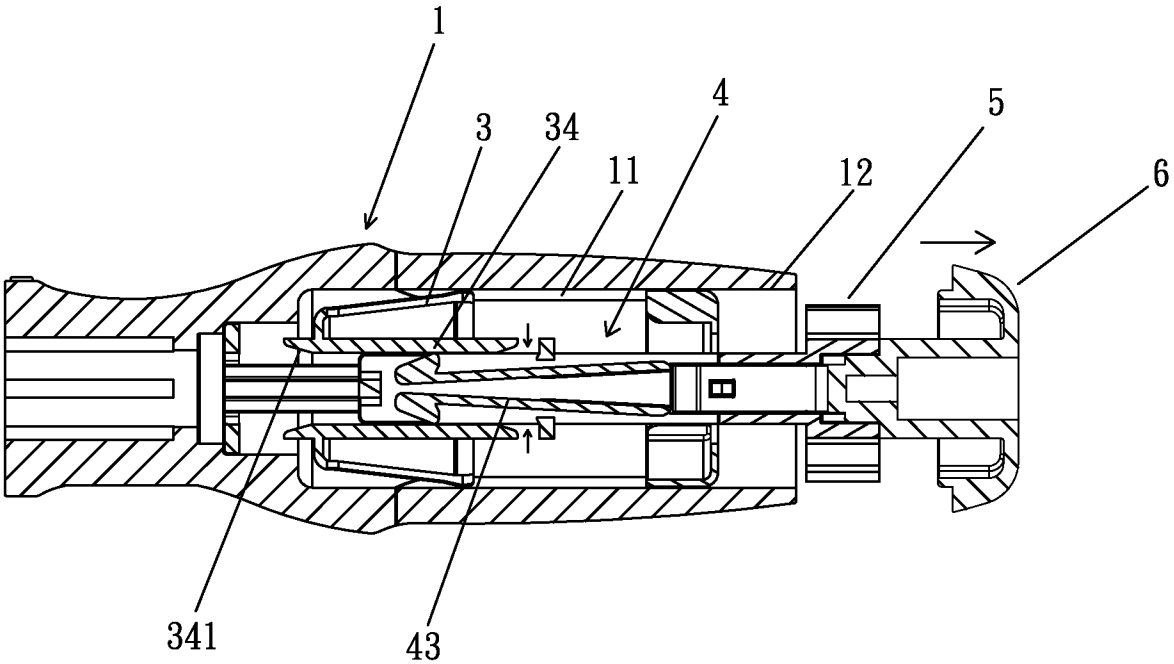
FIG. 5 is a view similar to FIG. 3, illustrating movement of the bit seat to an extended position.

With reference to FIGS. 5 and 6, when the bit seat 2 is moved to the extended position (FIG. 7) by pulling the end cap 6 away from the handle 1, the coupling seat 5 moves out of the compartment 11 of the handle 1, the front inclined guiding faces 341 guide the positioning members 432 of the first and second resilient arms 43 into a space between the first and second abutment walls 34. The first and second resilient arms 43 abut against the first and second abutment walls 34 to constrain movement. Since the column 41 and the longitudinal hole 32 have non-circular cross sections, the reciprocating member 4 can move stably in the longitudinal direction.

Figure 7:
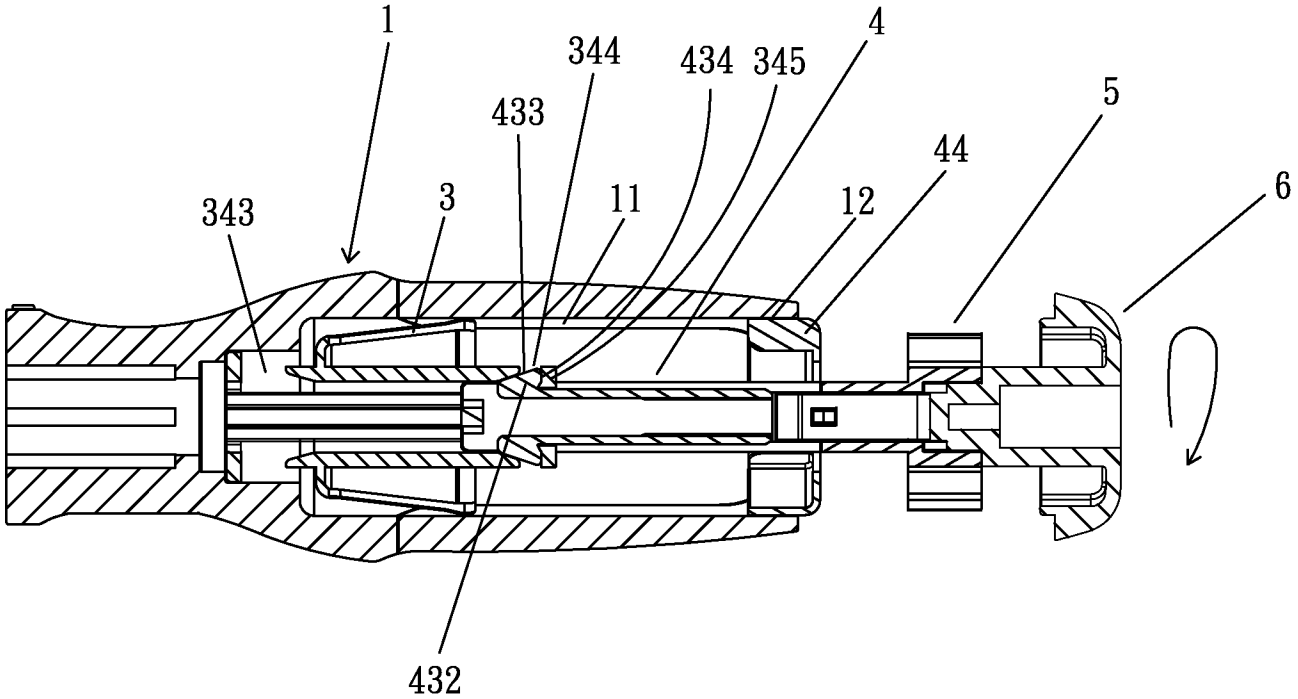
FIG. 7 shows a cross sectional view of the tool handle of FIG. 6.

With reference to FIGS. 6 and 7, the positioning members 432 of the reciprocating member 4 are moved into the rear positioning holes 344 of the first and second abutment walls 34 under action of the first and second resilient arms 43 when the positioning members 432 reach a location aligned with the rear inclined guiding faces 342. The abutment edges 434 abut the rear stops 345 to prevent the reciprocating member 4 from disengaging from the handle 1. The annular portion 44 of the reciprocating member 4 is located in the opening 12 of the handle 1. The coupling seat 5 is located outside of the handle 1 to allow easy removal of the screwdriver bits 7. The stop 14 of the handle 1 is disengaged from the positioning hole 441 of the annular portion 44 such that end cap 6 is pivotable to pivot the pivotable base 3, the reciprocating member 4, and the coupling seat 5 relative to the handle 1.

When the bit seat 2 is moved from the extended position to the storage position, the positioning members 432 of the reciprocating member 4 are moved into the front positioning holes 344 of the first and second abutment walls 34 under action of the first and second resilient arms 43 when the positioning members 432 reach a location aligned with the front inclined guiding faces 341, providing stable movement and convenient use without using any spring while providing enhanced stability during movement.

The reciprocating member 4 does not have to include the positioning hole 441, and the handle 1 does not have to include the stop 14 without the risks of falling of the bit seat 2 from the handle 1.

Although specific embodiments have been illustrated and described, numerous modifications and variations are still possible without departing from the essence of the invention. The scope of the invention is limited by the accompanying claims.

The invention claimed is:

1. A tool handle comprising:

a handle (1) including a compartment (11) having an opening (12) in a rear end thereof in a longitudinal direction of the handle (1), with the compartment (11) including an inner periphery having an abutment rib (13);

a bit seat (2) received in the compartment (11) of the handle (1), with the bit seat (2) movable relative to the handle (1) between a storage position received in the compartment (11) and an extended position partially outside of the compartment (11), with the bit seat (2) including a pivotable base (3), a reciprocating member (4), a coupling seat (5), and an end cap (6), with the pivotable base (3) including a longitudinal hole (32) and an outer periphery, with an abutment flange (312) formed on the outer periphery of the pivotable base (3), with the abutment rib (13) of the handle (1) abutting the abutment flange (312) of the pivotable base (3), preventing the pivotable base (3) from moving in the longitudinal direction of the handle (1), with the longitudinal hole (32) of the pivotable base (3) including an inner periphery having a first abutment wall (34) with two ends, with the two ends of the first abutment wall (34) respectively including front and rear positioning holes (344), with the reciprocating member (4) including a column (41) on a front end thereof, with the column (41) extending through the longitudinal hole (32) of the pivotable base (3), with the reciprocating member (4) movable in the longitudinal direction relative to the pivotal base (3) and not rotatable relative to the pivotal base (3), with the reciprocating member (4) including a first resilient arm (43) corresponding to first abutment wall (34), with the first resilient arm (43) including a positioning member (432) on a front end thereof, with the reciprocating member (4) further including an engaging portion (45) on a rear end thereof, with the engaging portion (45) having a receiving hole (451), with the coupling seat (5) including a plurality of bit grooves (51) in an outer periphery thereof, with the plurality of bit grooves (51) adapted for receiving a plurality of screwdriver bits (7), with the coupling seat (5) including a central hole (52), with the end cap (6) including a tongue (61) on a front end thereof and a base (62) on a rear end thereof, with the tongue (61) extending through and engaged in the central hole (52) of the coupling seat (5) and the receiving hole (451) of the reciprocating member (4) in the longitudinal direction, with the reciprocating member (4), the coupling seat (5) and the end cap (6) jointly movable in the longitudinal direction, wherein when the bit seat (2) is in the storage position, the coupling seat (5) is received in the compartment (11) of the handle (1), the end cap (6) covers the opening (12) of the handle (1), the positioning member (432) of the first resilient arm (43) of the reciprocating member (4) is engaged with the front positioning hole (343) of the first abutment wall (34), wherein when the bit seat (2) is moved to the extended position by pulling the end cap (6) away from the handle (1), the coupling seat (5) moves out of the compartment (11) of the handle (1), the first resilient arm (43) abuts against the first abutment wall (34) to constrain movement, the positioning member (432) of the first resilient arm (43) of the reciprocating member (4) is engaged with the rear positioning hole (344) of the first abutment wall (34), the end cap (6) is pivotable to pivot the pivotable base (3), the reciprocating member (4), and the coupling seat (5) relative to the handle (1).

2. The tool handle as claimed in claim 1, with a stop (14) formed on the inner periphery of the compartment (11) of the handle (1), with the reciprocating member (4) including an annular portion (44) on the rear end thereof, with the annular portion (44) including a positioning hole (441), with the annular portion (44) located in the opening (11) of the handle (1) when the bit seat (2) is in the extended position, with the stop (14) of the handle (1) engaged with the positioning hole (441) of the annular portion when the bit seat (2) is in the storage position, preventing the bit seat (2) from rotating relative to the handle (1).

3. The tool handle as claimed in claim 1, with the pivotable base (3) including a resilient annular wall (31) on the outer periphery thereof, with the resilient annular wall (31) including a plurality of slits (311) to provide the resilient annular wall (31) with a room for flexible movement, with the abutment flange (312) formed on an end of the resilient annular wall (31).

4. The tool handle as claimed in claim 1, with the inner periphery of the longitudinal hole (32) of the pivotable base (3) including two guiding grooves (33), with the column (41) of the reciprocating member (4) including two guiding wings (42) slideably received in the two guiding grooves (33).

5. The tool handle as claimed in claim 1, with the inner periphery of the longitudinal hole (32) of the pivotal seat (3) including a second abutment wall (34) opposite to the first abutment wall (34), with the reciprocating member (4) including a second resilient arm (43) corresponding to second abutment wall (34), with the second resilient arm (43) abutting against the second abutment wall (34), with each of the first and second resilient arms (43) including a slit (431) to provide the first and second resilient arms (43) with room for flexible movement, with the second resilient arm (43) including a positioning member (432) on a front end thereof, with the positioning member (432) of each of the first and second resilient arms (43) including a slant guiding face (433) and an abutment edge (434), with two rear stops (345) respectively formed behind the rear positioning holes (344) of the first and second abutment walls (34), with a spacing between outer edges of the positioning members (432) of the first and second resilient arms (43) being smaller than a spacing between the first and second abutment walls (34) of the pivotable base (3), with each of the first and second abutment walls (34) having front and rear inclined guiding faces (341, 342) at the two ends thereof, with the front inclined guiding faces (341) guiding the positioning members (432) of the first and second resilient arms (43) into a space between the first and second abutment walls (34) when the bit seat (2) is moved from the storage position to the extended position, with the positioning members (432) of the reciprocating member (4) moved into the rear positioning holes (344) of the first and second abutment walls (34) under action of the first and second resilient arms (43) when the positioning members (432) reach a location aligned with the rear inclined guiding faces (342), with the abutment edges (434) abutting the two rear stops (345) to prevent the reciprocating member (4) from disengaging from the handle (1), wherein when the bit seat (2) is moved from the extended position to the storage position, the positioning members (432) of the reciprocating member (4) are moved into the front positioning holes (344) of the first and second abutment walls (34) under action of the first and second resilient arms (43) when the positioning members (432) reach a location aligned with the front inclined guiding faces (341).

6. The tool handle as claimed in claim 5, with the receiving hole (451) of the engaging portion (45) of the reciprocating member (4) including an inner periphery having a coupling hole (452) and a coupling member (453), with an engaging slot (454) defined in the inner periphery of the receiving hole (451) of the engaging portion (45), with the central hole (52) of the coupling seat (5) including an inner periphery having a coupling hole (53), with a protrusion (54) formed on the front end of the inner periphery of the central hole (52) of the coupling seat (5), with the protrusion (54) engaged with the engaging slot (454) of the reciprocating member (4), preventing the coupling seat (5) from rotating relative to the reciprocating member (4), with the tongue (61) of the end cap (6) including a coupling member (611) and a coupling hole (612), with the coupling member (611) of the tongue (61) engaged with the coupling hole (452) of the reciprocating member (4), with the coupling member (453) of the reciprocating member (4) engaged in the coupling hole (612) of the tongue (61) of the end cap (6), with the tongue (61) further including an engaging member (613) engaged with the coupling hole (53) of the coupling seat (5).

* * * * *